US009849693B1

(12) United States Patent
Liu et al.

(10) Patent No.: US 9,849,693 B1
(45) Date of Patent: Dec. 26, 2017

(54) SYSTEMS AND METHODS FOR PRINTING ON LARGE SURFACE WITH PORTABLE PRINTING DEVICES

(71) Applicant: FUJI XEROX CO., LTD., Tokyo (JP)

(72) Inventors: Qiong Liu, Cupertino, CA (US); Shang Ma, Irvine, CA (US); Donald Kimber, Foster City, CA (US); Patrick Chiu, Mountain View, CA (US); Sven Kratz, San Jose, CA (US)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/253,808

(22) Filed: Aug. 31, 2016

(51) Int. Cl.
*B41J 2/47* (2006.01)

(52) U.S. Cl.
CPC ..... *B41J 2/47* (2013.01)

(58) Field of Classification Search
CPC .... G06F 3/1292; G06F 3/1285; G06F 3/1201; B41J 11/008; B41J 3/36; B41J 2/47; B41F 15/0859; B65H 2555/32; H01N 1/10; H01N 1/47
USPC ..... 347/232
See application file for complete search history.

(56) References Cited

U.S. PATENT DOCUMENTS 5,855,297 A * 1/1999 Tichenor ..... G08B 15/00 222/153.11
6,116,707 A * 9/2000 Avida ..... B43L 13/024 346/139 R
8,922,817 B2 12/2014 Matsumoto
2007/0046924 A1* 3/2007 Chang ..... G01C 7/00 356/3.01
2013/0328953 A1* 12/2013 Jones ..... B41J 29/38 347/9
2014/0233099 A1* 8/2014 Stark ..... G09F 21/06 359/446

OTHER PUBLICATIONS https://www.wired.com/2014/04/a-nightmare-for-cops-a-drone-that-paints-graffiti/ "This Open Source Graffiti Drone Will Give Cops Nightmares", Wired, by Kyle Vanhemert, published Apr. 16, 2014.*
AxiDraw: http://www.axidraw.com/ visited on Sep. 11, 2016.
Vertical Plotter: https://www.youtube.com/watch?v=3dWSO0D5VU4 visited on Sep. 11, 2016.
Speed-i-Marker: http://handheldinkjet.com/products/handheld-inkjet/speed-i-marker-940/ visited on Sep. 11, 2016.
(Continued)

*Primary Examiner* — Huan Tran
*Assistant Examiner* — Alexander D Shenderov
(74) *Attorney, Agent, or Firm* — TransPacific Law Group; Pavel I. Pogodin, Esq.

(57) ABSTRACT

Computerized systems and computer-implemented methods that enable printing on a large solid surface, such as a floor, wall, or ceiling using mobile printer heads guided by coded light. In one implementation, a user points a projector onto the printing surface to project a sequence of images with a unique temporal identifier (ID) for each pixel, wherein different space partitions are associated with different pixel IDs. The mechanical transmissions of the conventional printers are replaced with the aforesaid coded light used in conjunction with small mobile printer heads equipped with light sensors, while the coded light is used to guide the printer heads' movements during the printing process.

21 Claims, 10 Drawing Sheets

(56) References Cited

OTHER PUBLICATIONS

3&Dbot: http://gizmodo.com/a-robotic-3d-printer-could-print-anything-anywhere-it-1635776163 visited on Sep. 11, 2016.
Minibuilder: http://www.gizmag.com/minibuilder-robots-3d-print-large-scale-structures/32573/.
Mini Mobile Robotic Printer: https://www.kickstarter.com/projects/1686304142/the-mini-mobile-robotic-printer/posts/1608579 visited on Sep. 11, 2016.
Takefumi Hiraki, Issei Takahashi, Shotaro Goto, Shogo Fukushima and Takeshi Naemura, "Phygital Field: Integrated Field with Visible Images and Robot Swarm Controlled by Invisible Images," Proceedings, Siggraph '15 ACM SIGGRAPH 2015 Posters, Article No. 85, Los Angeles, California—Aug. 9-13, 2015.

* cited by examiner

SYSTEMS AND METHODS FOR PRINTING ON LARGE SURFACE WITH PORTABLE PRINTING DEVICES

BACKGROUND OF THE INVENTION

Technical Field

The disclosed embodiments relate in general to printing systems and methods and, more specifically, to systems and methods for printing on large surface with portable printing devices.

Description of the Related Art

Printing technology can be traced back to the 2nd century. Before a rotary press was invented in 1843, nearly all printing machines existing at the time utilized a plate as large as the printed area. For example, FIG. 1 shows a printed map that has the same size as the lithography stone used for its printing.

With the invention of the rotary press, the images to be printed were curved around a cylinder and thus the plate's maximum linear dimension was reduced to nearly a third of its original size. The invention of the aforesaid rotary press enabled much larger prints within a relatively smaller space. FIG. 2 shows an exemplary side view of an offset printing process where the printing plate is wrapped around a plate cylinder. In this process, ink and water are first delivered to cover the plate cylinder. The plate cylinder transfers ink onto the offset cylinder. Then, the paper is pressed against the offset cylinder by the impression cylinder to transfer ink from the offset cylinder onto the paper. This type of offset printing is still one of the most common ways of printing newspapers, magazines and books etc.

Modern laser printer invented by the Xerox Corporation in 1969 removed the offset cylinder and directly transfer toner from a cylindrical drum to paper surface. FIG. 3 shows an exemplary diagram of a laser printer. It charges negative electrostatic charge onto revolving photosensitive drum, uses a laser beam to project a raster image on the drum and neutralize the charge at the lighted spot. When toner is pressed onto the drum surface, toner particles can only stay on neutralized surface area and thus form an image on the drum surface. The toner-formed image is then transferred to paper. Because the raster image projected by the laser beam can be formed on the drum line-after-line dynamically, the drum diameter can be greatly reduced compared with a traditional offset printer. However, the width of the drum and transfer roll etc. cannot be reduced. In other words, the maximum paper width is still strictly limited by the drum and roll width.

Beyond the laser printer, inkjet printer, well known in the art, is another type of widely used modern printer. FIG. 4 illustrates an exemplary inkjet printer. In this figure, we can find that simple inkjet printer directly dispensed ink onto the paper based on the printer head horizontal position and paper-feeding-length. With this design, the printer can completely eliminate printing plate and thus can easily achieve a small size. On the other hand, because it still uses a stabilizer bar, a fixed length driving belt, and paper advance rollers etc., the printing surface width is still limited.

As would be appreciated by persons of ordinary skill in the art, modern printers are fast and accurate. On the other hand, conventional printers occupy a large space, have strict requirements to printing surface (i.e. paper or slide), and have very restricted printing size limited by the machine frame size. Additionally, as would be appreciated by persons of ordinary skill in the art, the machine size reduction will be limited by mechanical transmission requirements.

In view of the above and other shortcomings of the conventional printing technology, new and improved systems and methods for printing are needed that would enable printing on large surfaces composed on diverse materials without the proportional increase in size of the printing machine.

SUMMARY OF THE INVENTION

The embodiments described herein are directed to systems and methods that substantially obviate one or more of the above and other problems associated with the conventional printing systems and methods.

In accordance with one aspect of the embodiments described herein, there is provided a printing system incorporating: a projector configured to project a temporal projector light signal, wherein the temporal projector light signal is encoded, for each pixel of the projector, with an information segment including the pixel coordinates of the each pixel of the projector; and an autonomous mobile printing head incorporating a drive unit, a light sensor, a color application actuator and an onboard computer operatively coupled to the light sensor, the drive unit and the color application actuator, wherein the light sensor is configured to detect the temporal projector light signal and generate a sensor signal and wherein the onboard computer is configured to receive a sensor signal from the light sensor, to determine a location information of the autonomous mobile printing head based on the detected temporal projector light signal, to issue a guidance command to the drive unit based on the detected location of the autonomous mobile printing head and to issue a color application command to the color application actuator based on the detected location of the autonomous mobile printing head.

In one or more embodiments, the onboard computer of the autonomous mobile printing head determines the location information of the autonomous mobile printing head by identifying a projector pixel corresponding to the sensor signal.

In one or more embodiments, the location information of the autonomous mobile printing head includes position of the autonomous mobile printing head with respect to a printing surface.

In one or more embodiments, the onboard computer of the autonomous mobile printing head is configured to receive an image that associates a predetermined color pixel to each location of the autonomous mobile printing head on a printing surface and wherein the color application command issued to the color application actuator is based, at least in part, on the detected location of the autonomous mobile printing head and the received image.

In one or more embodiments, the autonomous mobile printing head includes a wireless receiver configured to receive the image.

In one or more embodiments, the onboard computer of the autonomous mobile printing head is configured to receive a printing path for the autonomous mobile printing head and wherein the guidance command issued to the drive unit is based, at least in part, on the received printing path.

In one or more embodiments, the light sensor is configured to detect a color of the temporal projector light signal and wherein the color application command issued to the color application actuator is based on the detected color.

In one or more embodiments, the temporal projector light signal is encoded, for at least one pixel of the projector, with a color information segment including color information corresponding to the at least one pixel of the projector.

In one or more embodiments, the autonomous mobile printing head is an aerial drone, wherein the projector is positioned below the aerial drone, wherein the light sensor is positioned on the bottom side of the aerial drone and wherein the onboard computer issues the guidance command to guide the aerial drone to perform printing.

In one or more embodiments, the autonomous mobile printing head is a wheeled robot.

In one or more embodiments, the autonomous mobile printing head further includes a color spray can, wherein the color application actuator is an electronically controlled valve.

In one or more embodiments, the autonomous mobile printing head further includes a pen, wherein the color application actuator is a solenoid configured to move the pen to or from a printing surface.

In one or more embodiments, the autonomous mobile printing head further includes a water vaporizer, wherein the color application actuator is an electronically controlled valve.

In one or more embodiments, the autonomous mobile printing head includes a second light sensor configured to detect the temporal projector light signal and generate a second sensor signal and wherein the onboard computer of the autonomous mobile printing head determines the location information of the autonomous mobile printing head by identifying a second projector pixel corresponding to the second sensor signal.

In one or more embodiments, the autonomous mobile printing head includes a second light sensor configured to detect the temporal projector light signal and generate a second sensor signal, wherein the onboard computer of the autonomous mobile printing head determines orientation information of the autonomous mobile printing head by identifying a projector pixel corresponding to the sensor signal and a second projector pixel corresponding to the second sensor signal and wherein the orientation information is determined based on the identified first projector pixel and the second projector pixel.

In one or more embodiments, the autonomous mobile printing head includes a suction unit for creating a suction force for forcing the autonomous mobile printing head against a printing surface.

In one or more embodiments, the suction unit is an electrical fan.

In one or more embodiments, the temporal projector light signal projected by the projector includes a plurality of sequential light pulses encoding pixel coordinates of the each pixel of the projector.

In one or more embodiments, the projector is attached to an aerial drone.

In accordance with another aspect of the embodiments described herein, there is provided a printing method involving: using a projector to project a temporal projector light signal, wherein the temporal projector light signal is encoded, for each pixel of the projector, with an information segment including the pixel coordinates of the each pixel of the projector; detecting the temporal projector light signal using a light sensor of an autonomous mobile printing head and generating corresponding sensor signal, the autonomous mobile printing head including a drive unit and a color application actuator; and using an onboard computer of the autonomous mobile printing head to receive the sensor signal, to determine a location of the autonomous mobile printing head based on the detected temporal projector light signal, to issue a guidance command to the drive unit based on the detected location of the autonomous mobile printing head and to issue a color application command to the color application actuator based on the detected location of the autonomous mobile printing head.

In accordance with yet another aspect of the embodiments described herein, there is provided a tangible computer-readable medium embodying a set of instructions implementing a printing method involving: using a projector to project a temporal projector light signal, wherein the temporal projector light signal is encoded, for each pixel of the projector, with an information segment including the pixel coordinates of the each pixel of the projector; detecting the temporal projector light signal using a light sensor of an autonomous mobile printing head and generating corresponding sensor signal, the autonomous mobile printing head including a drive unit and a color application actuator; and using an onboard computer of the autonomous mobile printing head to receive the sensor signal, to determine a location of the autonomous mobile printing head based on the detected temporal projector light signal, to issue a guidance command to the drive unit based on the detected location of the autonomous mobile printing head and to issue a color application command to the color application actuator based on the detected location of the autonomous mobile printing head.

Additional aspects related to the invention will be set forth in part in the description which follows, and in part will be obvious from the description, or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive technique. Specifically:

FIG. 7(*b*) illustrates an exemplary embodiment of a mobile printing head in a form of an aerial drone.

DETAILED DESCRIPTION

Figure 1:
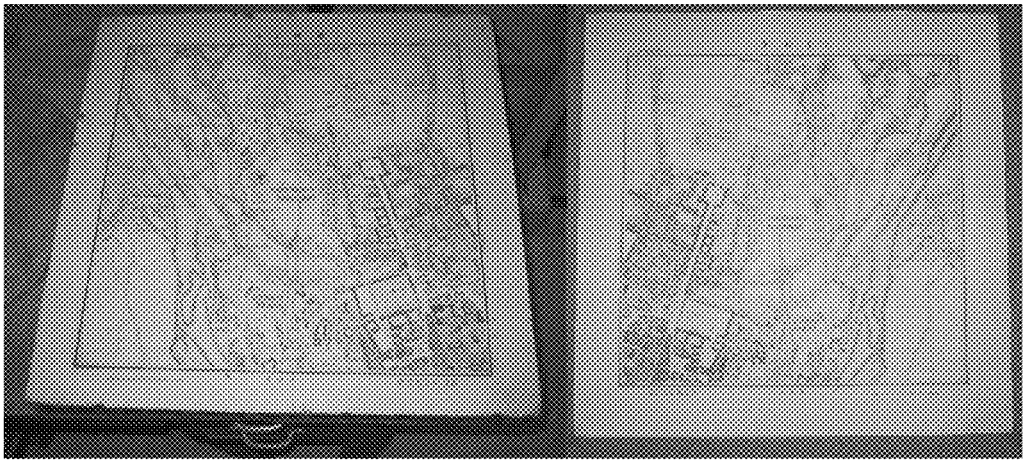
FIG. 1 shows a printed map that has the same size as the lithography stone used for its printing.
Figure 2:
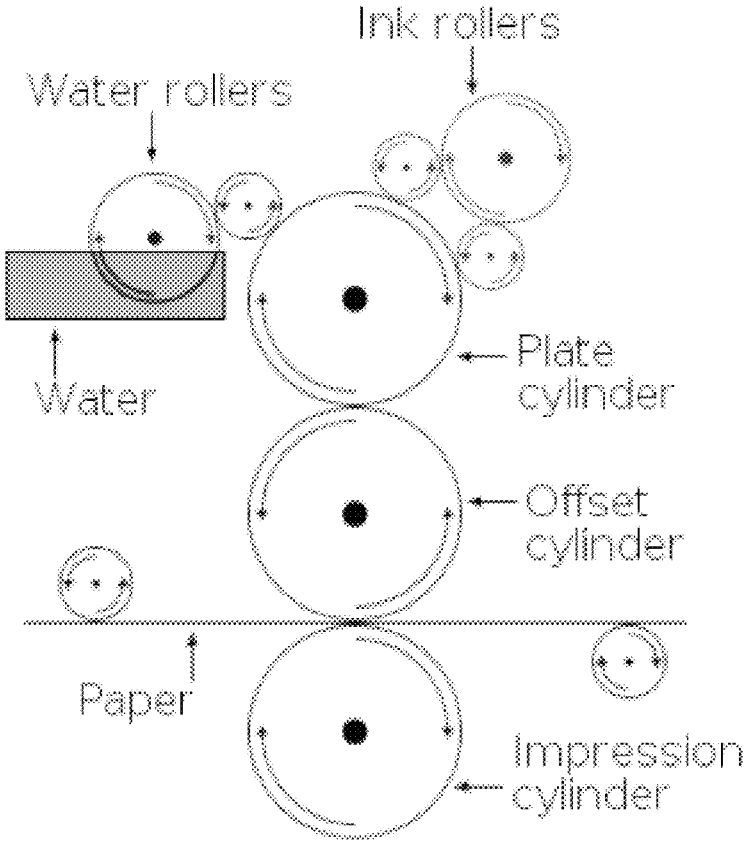
FIG. 2 shows an exemplary side view of an offset printing process where the printing plate is wrapped around a plate cylinder.
Figure 3:
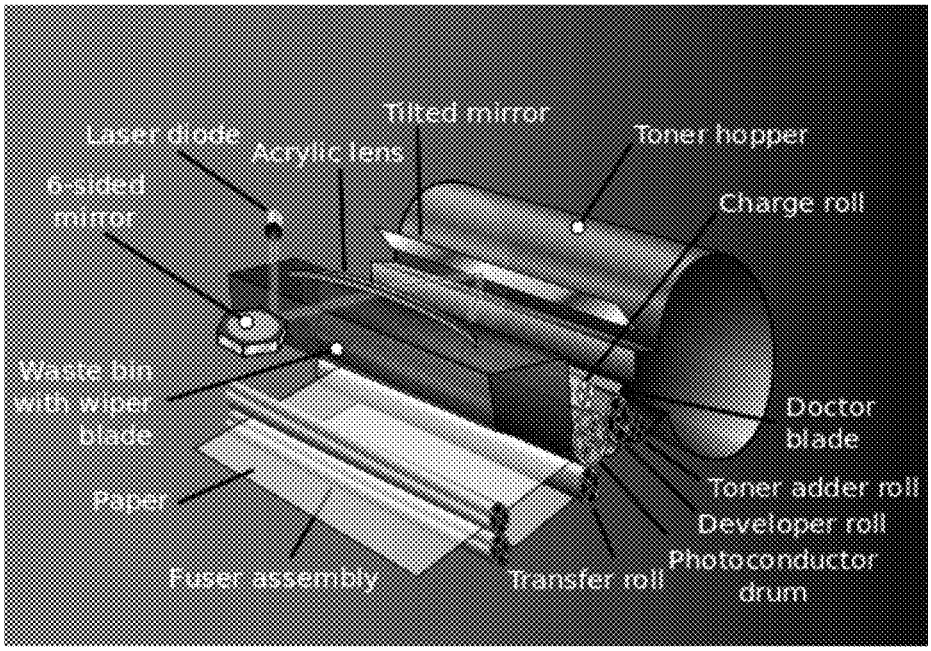
FIG. 3 shows an exemplary diagram of a laser printer.
Figure 4:
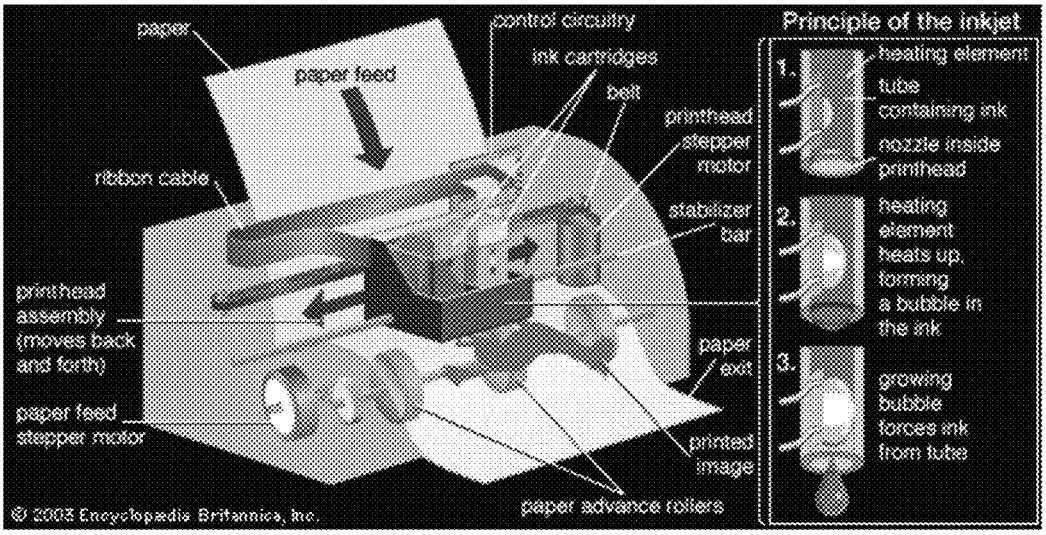
FIG. 4 illustrates an exemplary inkjet printer.

In the following detailed description, reference will be made to the accompanying drawing(s), in which identical functional elements are designated with like numerals. The aforementioned accompanying drawings show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense. Additionally, the various embodiments of the invention as described may be implemented in the form of a software running on a general purpose computer, in the form of a specialized hardware, or combination of software and hardware.

In accordance with one aspect of the embodiments described herein, there are provided computerized systems and computer-implemented methods that enable printing on a large solid surface, such as a floor, wall, or ceiling using mobile printer heads guided by coded light. More specifically, in accordance with one embodiment of the inventive technique, a user points a projector onto the printing surface to project a sequence of images with a unique temporal identifier (ID) for each pixel. In one or more embodiments, different space partitions are associated with different pixel IDs. In one or more embodiments, mechanical transmissions of the conventional printers are replaced with the aforesaid coded light used in conjunction with small mobile printer heads equipped with light sensors, while the coded light is used to guide the printer heads' movements during the printing process.

In one or more embodiments, using this coded light projection detected by one or more light sensor(s) disposed on an autonomous mobile printer head, the printer head moving on the printing surface is capable of determining its location and, optionally, orientation, at any given time. In one or more embodiments, the mobile printer head is configured to receive, for example via a wireless network, such as WIFI or Bluetooth, an image or a lookup table that associates a predetermined color pixel to each printing surface location. Therefore, the embodiment of the printing system enables the mobile printer head to print a color pixel based on its current location ID, as determined using the detection of the coded projector light.

Moreover, an embodiment of the described printing system may also guide the mobile printer head's movement based on a location ID map. Unlike a traditional laser printer or inkjet printer, the described embodiment does not need drums, rolls, cylinders, and complicated mechanical transmissions. By eliminating these mechanical components, a user can easily adjust printing size by modifying projection size. Because the light projection direction can be easily adjusted, the printing surface can be oriented at an arbitrary angle and it can be to a certain extent uneven. From the manufacturing standpoint, eliminating heavy and complicated mechanical parts can save materials, manufacturing costs, as well as printer transportation cost.

Figure 5:
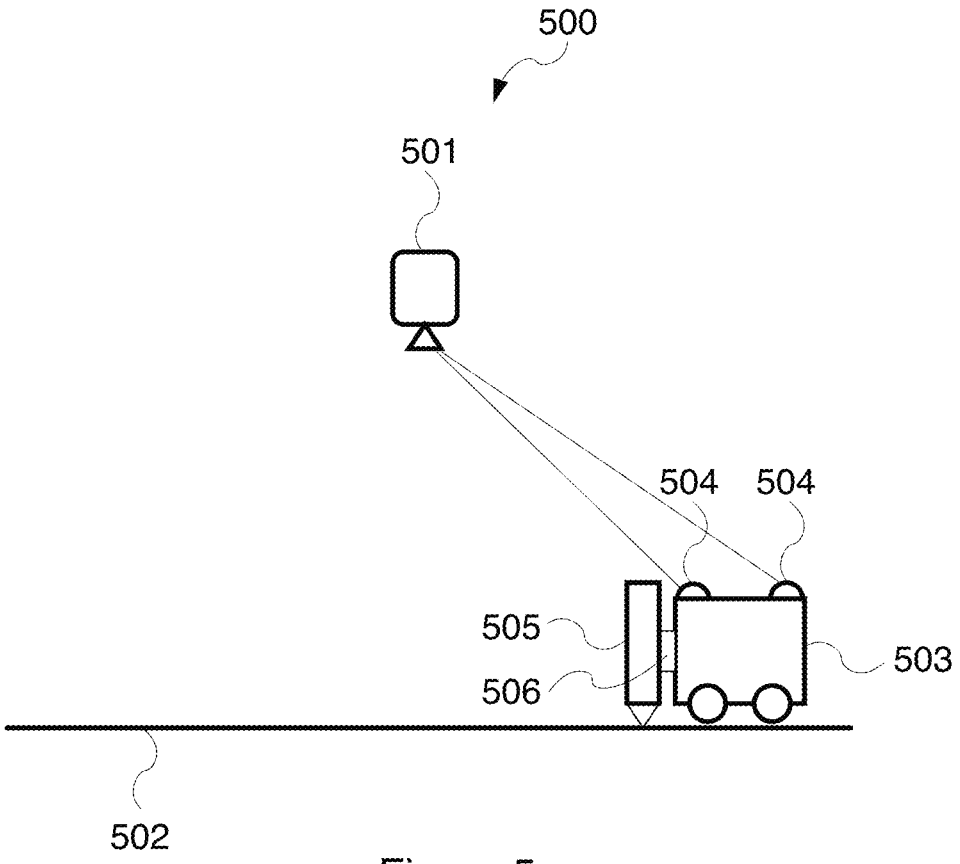
FIG. 5 illustrates an exemplary embodiment of a novel printing system.

An exemplary embodiment of a novel printing system 500 is illustrated in FIG. 5. In the system 500, a light source (projector 501) is installed such as to project a coded light onto a printing surface 502. As would be appreciated by persons of ordinary skill in the art, in this way, the entire printing surface 502 is partitioned based on different projector 501 pixels. The light signal of each projector pixel is modulated with a unique digital code and, in one embodiment, the aforesaid system 500 may use a two-dimensional reflected binary code (RBC) also called a gray code, well known to persons of ordinary skill in the art. In such a code, two successive values differ in only one bit (binary digit), which facilitates error correction in digital communications. The projector light modulation may be performed using a sequence of light pulses with each projector pixel being assigned a unique temporal light pulse sequence. When the aforesaid sequence of light pulses is detected using a luminosity sensor, well known to persons of ordinary skill in the art, a processing unit may be programmed to decode the received unique digital code and, consequently, uniquely identify the corresponding projector pixel, which would provide information on angular position of the aforesaid light sensor with respect to the projector 501.

A mobile printer head 503 is positioned on or about the printing surface 502 such as to detect the projected coded light using one or more light (luminosity) sensors 504. In various embodiments, the mobile printer head 503 may be implemented based on an aerial drone, a surface robot or any other mechanical mobile vehicle having a printing ability. Therefore, the invention is not limited to any specific type of the mobile printer head 503.

In one or more embodiments, in addition to the light sensors 504, the mobile printer head 503 may further incorporate a drive system including one or more electric motors, such as stepping motors, mechanically coupled to the wheels as well as one or more pens or spray cans 505 coupled to an actuated color application system 506 designed to cause it to draw or otherwise create a color pixel of a predetermined color on the printing surface. In one or more embodiments, the mobile printer head 503 may include multiple pens or splays 505 of primary colors, such as RGB or CMYK or the like. Those colors may be appropriately mixed to achieve a desired pixel color, as well known to persons of ordinary skill in the art.

Exemplary embodiments of the actuated color application system 506 may include a solenoid-based assembly for lowering the pen(s) onto the printing surface or an electronically controlled ink valve or pump for delivering the spray from the can(s) to the printing surface. As would be appreciated by persons of ordinary skill in the art, may other types of actuated color application systems are well known in the art and, therefore, the invention is not limited to any specific system.

In one or more embodiments, the mobile printer head 503 may further incorporate an onboard computer for controlling the motion of the mobile printer head 503 and the actuation of the pen or a spray can for applying the color to the printing surface. Finally, various components of the mobile printer head 503 may be mounted on a frame.

Figure 6A:
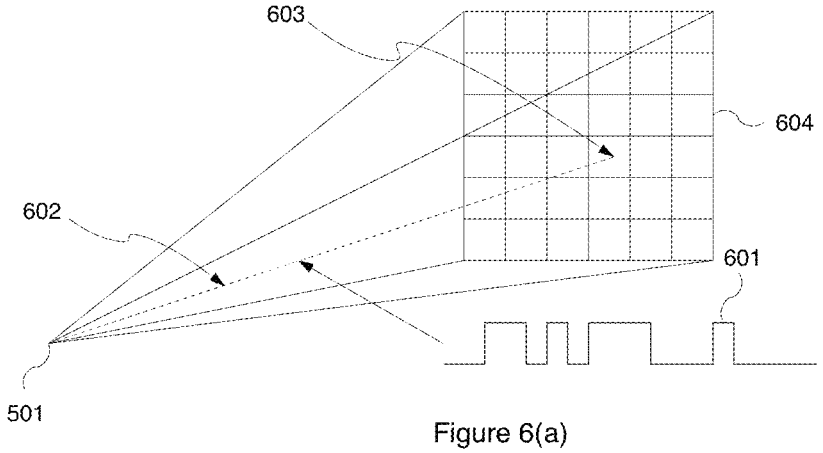
FIGS. 6(*a*) and 6(*b*) illustrate two temporal coded light signals 601 and 605 produced by the projector.
Figure 6B:
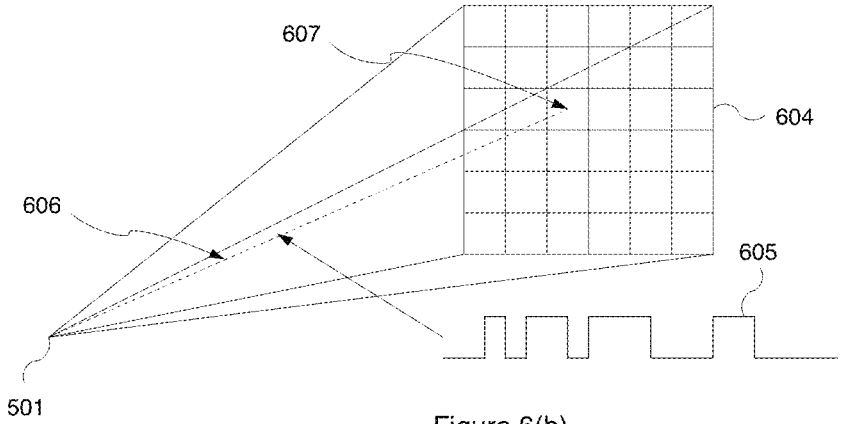

FIGS. 6(*a*) and 6(*b*) illustrate two temporal coded light signals 601 and 605 produced by the projector 501. In one embodiment, the projector 501 is a DLP projector, well known to persons of ordinary skill in the art. The temporal light signals 601 and 605 correspond to two different pixels 603 and 607 of the projector 501. The temporal light signal 601 propagating in the direction 602 is encoded with unique position information of the first projector pixel 603 using a corresponding first unique sequence of temporal light pulses. On the other hand, the temporal light signal 605 propagating in the direction 606 is encoded with unique position information of the second projector pixel 607 using a corresponding second unique sequence of temporal light pulses. In FIGS. 6(*a*) and 6(*b*) the projector pixels 603 and 607 are illustrated by their corresponding projections and on an imaginary projection surface 604. The aforesaid first and second sequences of light pulses are different and carry information about the respective projector pixel.

Figure 7A:
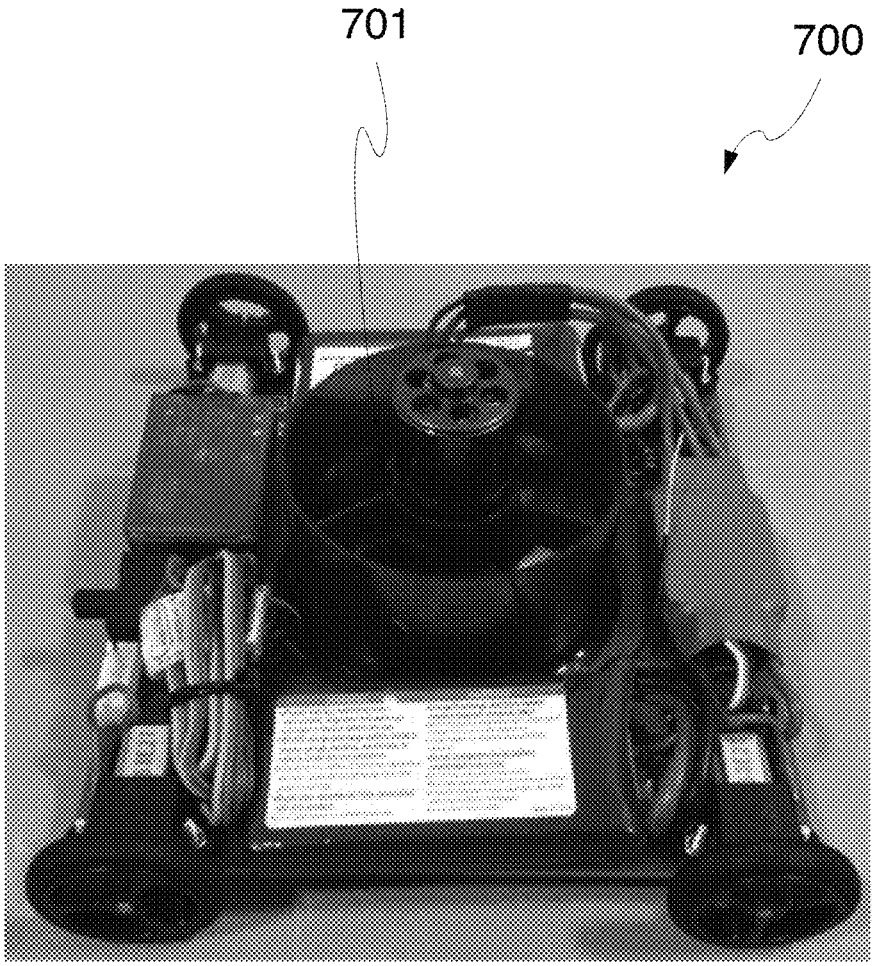
FIG. 7(*a*) illustrates an exemplary embodiment of a mobile printing head in a form of a wheeled robot provided with a suction fan.
Figure 7B:
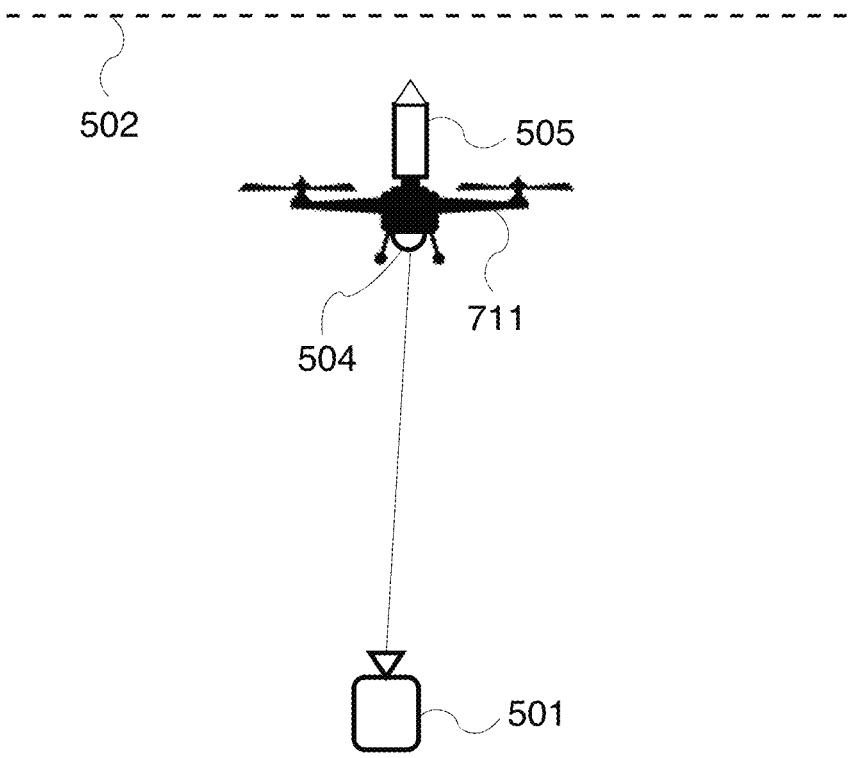

In one embodiment, the mobile printer head 503 is a wheeled robot. In one or more embodiments, the one or more light (luminosity) sensors 504 are installed on top of the wheeled robot and the projector 501 is installed above the printing surface 502. In one or more embodiments, to enable the wheeled robot to movably attach to a wall or a ceiling, the wheeled robot 700 may be provided with a suction fan 701, as shown in FIG. 7(*a*). When operating, the suction fan 701 creates an air suction that forces the wheeled robot against a surface of a wall or a ceiling. Thus, the wheeled robot may be used to print on those surfaces by appropriately positioning the projector 501.

In another embodiment, the mobile printer head 503 is an aerial drone 711, see FIG. 7(*b*). In various embodiments, the aerial drone may be a multi-copter, such as quad-copter. In one or more embodiments, one or more light sensors 504 are installed at the bottom of the aerial drone 711, while the projector 501 is mounted on the floor or otherwise beneath the printing surface 502, as shown, for example, in FIG. 7(*b*). However, as would be appreciated by persons of ordinary skill in the art, other embodiments may use a different number or locations of light sensors. For example, there could be multiple light sensors, such as four, installed, for instance, on the four sides of the aerial drone. Therefore, any other suitable number and/or location of the light sensors may be used for detecting the coded light signal emitted by the projector 501 without departing from the scope and spirit of the concepts described herein. The spray can or pen 505 may also be provided, as shown in FIG. 7(*b*). Finally, the drone 711 may be used to print in the air without any printing surface 502, using, for example, a water vapor generator.

In various embodiments, the light sensor(s) 504 may be luminosity sensors, such as photodiodes or phototransistors, which are well known to persons of ordinary skill in the art. It should also be noted that the exact design of the light sensors 504 is not critical to the inventive concepts described herein and any now known or later developed light sensor may be used for detecting coded light from the projector 501. In one or more embodiments, the light sensor(s) 504 are configured to receive digital code modulated light sent by the projector 501 when there is no obstacle between the light source of the projector 501 and the drone light sensor(s) 504. In other words, the light sensor(s) 504 are configured to detect light pulses corresponding to specific projector 501 pixel or pixels. On the other hand, the drone's or wheeled robot's onboard computer may use the output of the light sensor(s) 504 to decode corresponding projector pixel codes and determine the precise location of the drone or wheeled robot in relation to the projector 501.

As would be appreciated by persons of ordinary skill in the art, because each pixel of the light signal emitted by the projector 501 is modulated with a fixed and unique sequential (temporal) code, the onboard computer of the aerial drone or wheeled robot is able to determine its exact position on the printing surface, when it receives a code from one of its light sensor(s) 504. In addition, using a signal from a second light sensor, the aerial drone or wheeled robot is able to determine its orientation on the printing surface. Based on the received code, the onboard computer of the aerial drone or the wheeled robot can also determine codes in nearby surface regions corresponding to neighboring projector pixels, through the predefined projection pattern.

Figure 8:
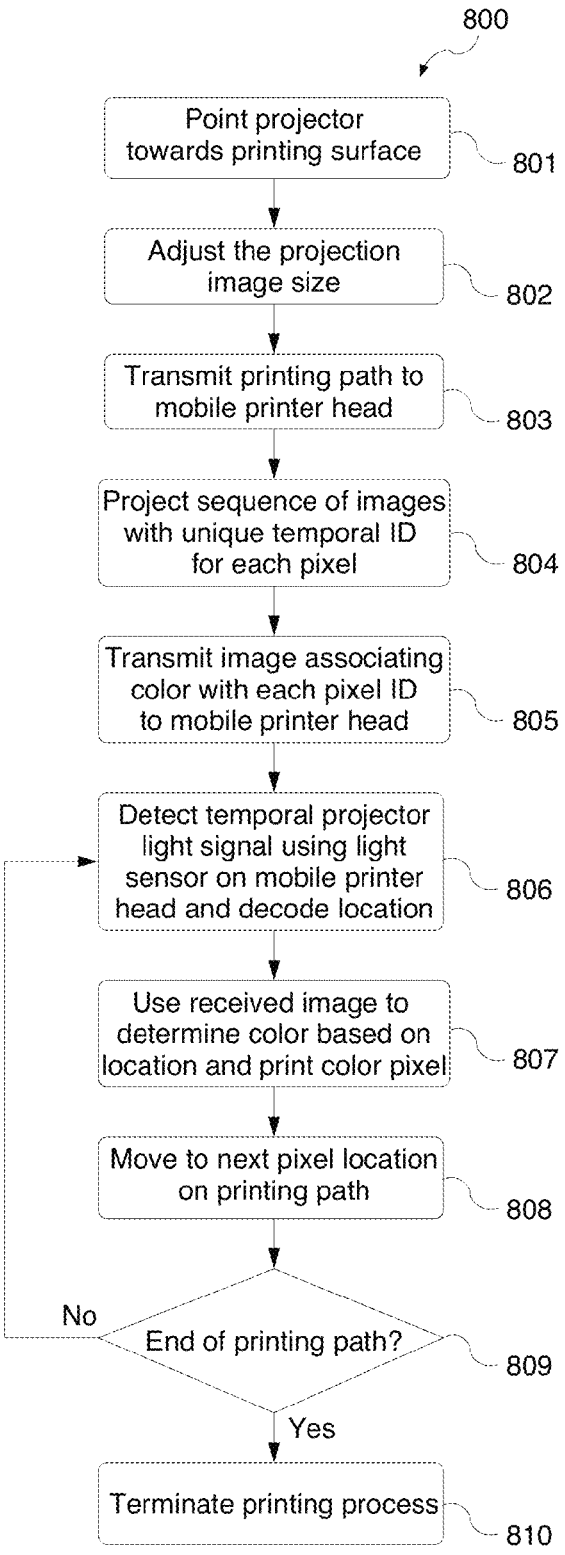
FIG. 8 illustrates and exemplary embodiment of a printing process performed in connection with a novel printing system illustrated in FIG. 5.

FIG. 8 illustrates and exemplary embodiment of a printing process 800 performed in connection with a novel printing system 500 illustrated in FIG. 5. Specifically, at step 801, the projector projecting a light encoded with coordinate information is pointed towards the printing surface. At step 802, the projection image size of the projector is appropriately adjusted using, for example, the projector's objective lens and/or by adjusting the distance between the projector and the printing surface. At step 803, printing path information is transferred to the mobile printer head 503 using, for example, wireless network or any other data transfer interconnect. Subsequently, at step 804, a sequence of images with a unique temporal ID for each pixel is projected onto the printing surface. At step 805, an image that associates a color pixel to each surface location is transmitted to the mobile printer head 503. At step 806, the mobile printer head 503 uses one or more light sensors disposed on the mobile printer head to receive the temporal signal and uses its onboard computer to decode the mobile printer head location on printing surface. At step 807, the mobile printer head 503 looks up the pixel color corresponding to the current mobile printer head location and prints a color pixel corresponding to printer head's current location (or pixel ID). At step 808, the mobile printer head 503 moves to the next pixel location on the printing path. At step 809, the process checks if the mobile printer head 503 reached the end of its path and, if otherwise, operation proceeds back to step 806. If the end of the printing path is reached, the printing process is terminated at step 810.

As would be appreciated by persons of ordinary skill in the art, by using the novel printing system 500 shown in FIG. 5, one can easily eliminate many big mechanical parts customarily used in conventional printers, such as rollers, rails, gears, pulleys, belts, transmissions and the like. In one or more embodiments, the size of the printing area on the printing surface can be easily modified by, for example, adjusting the distance between the projector 501 and the printing surface 502.

Depending on the design of the projector 501, the printing size may also be appropriately altered by adjusting the focal distance of the objective lens of the projector 501. Additionally, as would be appreciated by persons of ordinary skill in the art, in the printing system 500, the printing surface is not restricted to a paper or a slide. To make sure the mobile printer head 503 can always work at nearly the same distance to the printing surface 502, such as floors, walls, and ceilings, in one embodiment, the mobile printer head 503 uses a fan to suck out air under the mobile printer head 503. In this embodiment, a negative air pressure is used to press the mobile printer head 503 against the printing surface as that shown in FIG. 7(*a*). Because, in one embodiment, the system 500 uses temporal location code to retrieve color corresponding to a printer head location, color reproduction is similar to conventional inkjet printers. Because the coded light can inform a printer head its current location and next location, the system can easily guide the movement of the printer head. By designing shortest, safest, and most energy efficient travel path, the system 500 is capable of guiding the mobile printer head 503 in a most efficient manner. Moreover, in one or more embodiments, the coded light emitted by the projector 501 can support coordination of multiple mobile printer heads 503 to increase the printing speed, while the traditional inkjet printers do not have such flexibility because of the associated frame size limitations.

In addition, as would be appreciated by persons of ordinary skill in the art, because one can adjust the scale of the printing image by adjusting the location or objective lens of the projector 501, the pixel size on a printing area may be different from time to time. To make the printing sharp, an embodiment of the novel printing system 500 will use a pen/brush/spray, which has a mark size smaller than a smallest printing pixel. When a pixel becomes bigger, the simplest way is to use a thin pen to draw multiple times to fill one pixel area. A more complicated way is to move the spray nozzle away from the surface to enlarge its marking size. Another way is to change the pen/brush size based on the projection pixel size.

As was explained above, compared with lithography printing, rotary press reduces printing plate maximum dimension and increases printing speed by curving traditional printing plate around a cylinder. Laser printer further reduces the printing plate size by generating printing plate for partial page instead of the whole page. Because the laser printer needs to generate partial printing plate in real-time, its printing speed will be slower than the traditional rotary press printing. On the other hand, because the printing plate on a laser printer drum is much easier to create than a traditional plate for the rotary press printing, laser printing performs very well for medium volume printing. On the other hand, inkjet printer can completely eliminate the printing plate by using a printer head to print individual pixels. That makes the inkjet printer even more compact than the laser printer. On the other hand, because mechanical belt-driven printer head is much slower than the laser scanning, the inkjet printer is much slower than the laser printer. This is the reason why inkjet printer is predominantly used for personal small volume printing tasks.

On the other hand, the novel printing system 500 shown in FIG. 5 replaces inkjet printer's belt-driven printer head with a mobile, wheel-driven printer head. This modification eliminates the inkjet printer frame requirement and the associated printing size limitations. This improvement allows users to print on much larger areas with much smaller printers. Because wheels may be designed to have a much smaller dimension than a driving belt or rail, it will be easier to scale up the described printing system 500 with multiple printer heads for improving printing speed.

In another embodiment, an alternative color reproduction approach is used, wherein the projector 501 is configured to project a color image on the printing surface 502 and the mobile printing head 503 is equipped with a color sensor. In this embodiment, the printing system 500 can skip the internal color map and directly reproduce color based on the color values received from its light color sensor. One disadvantage of this approach is potential color reproduction nonlinearity. Specifically, as would be appreciated by persons of ordinary skill in the art, the color projector 501 may have color nonlinearity, the light sensor may have its nonlinearity, and the color reproduction (printing) system may also have its color nonlinearity. Therefore, addressing three different color nonlinearities in this embodiment of the printing system is much more difficult to handle than the only color printing nonlinearity in the printing system 500 shown in FIG. 5. Moreover, this alternative embodiment also needs to properly account for the ambient light conditions, which is a non-issue for the system 500 shown in FIG. 5.

In yet alternative embodiment, the color information for the pixel may be encoded into the coded projector light itself using a sequence of temporal light pulses, which may be time-multiplexed with the sequence of temporal light pulses carrying the pixel ID information as described above. The light sensor of the mobile printing head would detect both sequences of temporal light pulses and decode both the pixel ID and the corresponding pixel color. If the pixel is not to be painted, a predetermined color value, such as 000000 or FFFFFF could be used.

Additionally or alternatively, an embodiment of the printing system 500 may be adopted to perform a printing process in 3D. As would be appreciated by persons of ordinary skill in the art, most 3D printing robots known in the art operate to add printing materials to existing surfaces. In one embodiment, the printing system 500 may be adopted to remove materials from existing surface. Such an embodiment may be used as a sculpture-making robot. In another embodiment, the printing system 500 may be adopted for adding various materials to the printing surface, in the same manner as conventional 3D printers. In yet additional embodiment, the printing system 500 may be used for printing real-life houses using a cement mixture applied by means of an appropriate nozzle. In yet an alternative embodiment, an aerial drone printing head 503 may be equipped with a water vapor generator for creating water vapor trails in the air. In one embodiment, all such systems may rely on coded lighting for guiding the mobile printer head 503.

In one or more embodiments, the printing system 500 is used for printing road or other surface markings. In this embodiment, the projector 501 may be positioned over the roadway attached to a mast of an aerial drone. In another embodiment, the system may use multiple (two or more) projectors arranged in a matrix (or a grid) to achieve an extended coverage of the printing surface. Finally, in one embodiment, the system may use two projectors. In this embodiment, the first projector may be stationary and provide coarse positioning information using coded light with relatively large pixel size to achieve large coverage area. The second projector may be mounted on a turret and automatically pointed to the location of the flying drone or the wheeled robot and have relatively fine pixel size to achieve precise location measurement.

Exemplary Embodiment of Onboard Computer System of the Mobile Printer Head

Figure 9:
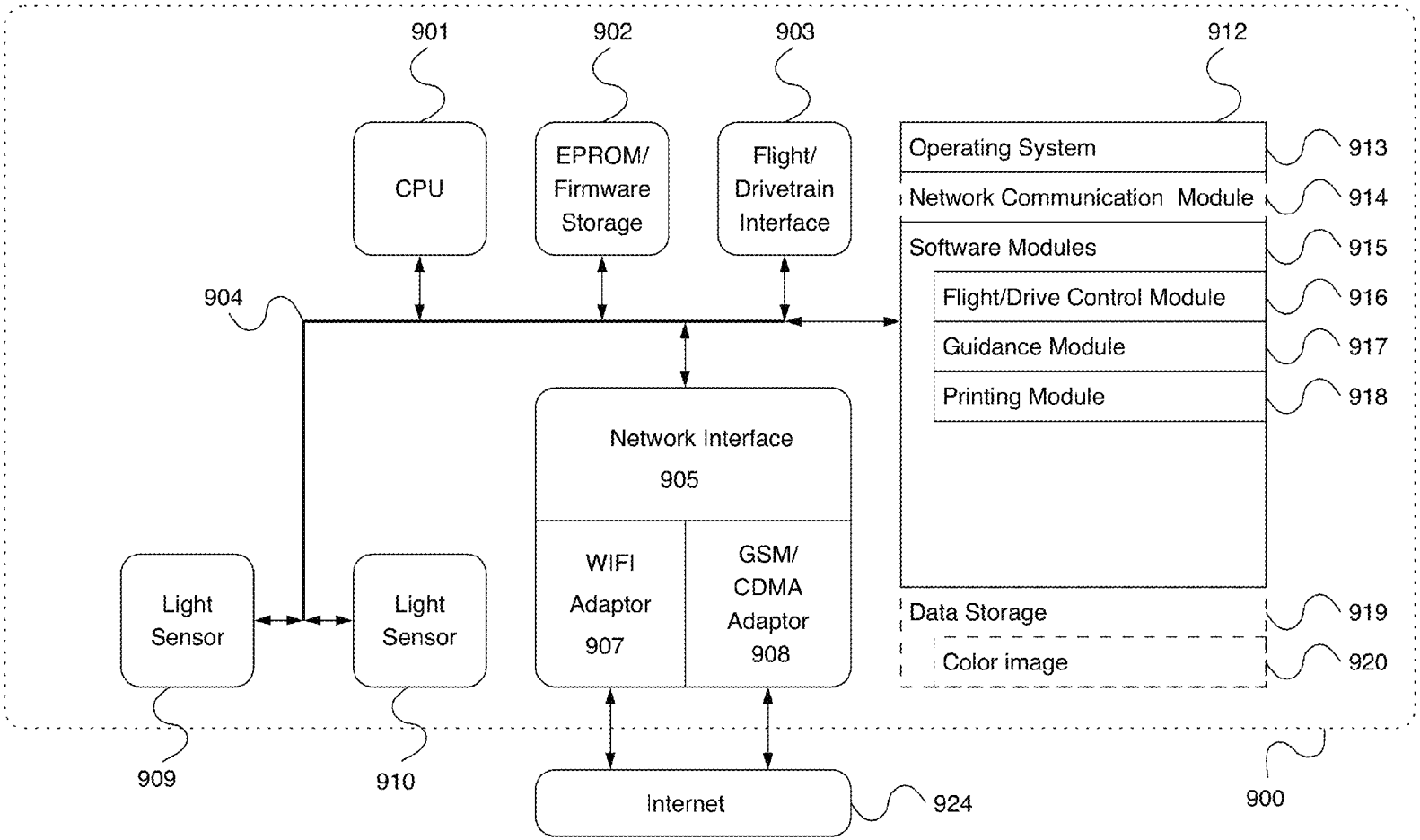
FIG. 9 illustrates an exemplary embodiment of an onboard computer of the mobile printer head, which may be used to implement the techniques described herein.

FIG. 9 illustrates an exemplary embodiment of an onboard computer 900 of the mobile printer head 503, which may be used to implement the techniques described herein. In one or more embodiments, the onboard computer 900 may be implemented within the form factor of a mobile computing device well known to persons of skill in the art. In an alternative embodiment, the onboard computer 900 may be implemented based on a laptop or a notebook computer. Yet in an alternative embodiment, the onboard computer 900 may be a specialized computing system, especially designed for the drone or the wheeled robot.

The onboard computer 900 may include a data bus 904 or other interconnect or communication mechanism for communicating information across and among various hardware components of the onboard computer 900, and a central processing unit (CPU or simply processor) 901 coupled with the data bus 904 for processing information and performing other computational and control tasks. The onboard computer 900 also includes a memory 912, such as a random access memory (RAM) or other dynamic storage device, coupled to the data bus 904 for storing various information as well as instructions to be executed by the processor 901.

The memory 912 may also include persistent storage devices, such as a magnetic disk, optical disk, solid-state flash memory device or other non-volatile solid-state storage devices.

In one or more embodiments, the memory 912 may also be used for storing temporary variables or other intermediate information during execution of instructions by the processor 901. Optionally, onboard computer 900 may further include a read only memory (ROM or EPROM) 902 or other static storage device coupled to the data bus 904 for storing static information and instructions for the processor 901, such as firmware necessary for the operation of the onboard computer 900, basic input-output system (BIOS), as well as various configuration parameters of the onboard computer 900.

In one or more embodiments, the onboard computer 900 may additionally incorporate two luminosity sensors 909 and 910 for detecting the coded light signal generated by the projector 501. In one embodiment, the luminosity sensors 909 and 910 have a fast response time to provide for high frequency position detection. In addition, the onboard computer 900 may incorporate a drivetrain or flight control interface 903 for controlling propellers of an aerial drone or drivetrain of the wheeled robot.

In one or more embodiments, the onboard computer 900 may additionally include a communication interface, such as a network interface 905 coupled to the data bus 904. The network interface 905 may be configured to establish a connection between the onboard computer 900 and the Internet 924 using at least one of WIFI interface 907 and the cellular network (GSM or CDMA) adaptor 908. The network interface 905 may be configured to provide a two-way data communication between the onboard computer 900 and the Internet 924. The WIFI interface 907 may operate in compliance with 802.11a, 802.11b, 802.11g and/or 802.11n protocols as well as Bluetooth protocol well known to persons of ordinary skill in the art. In an exemplary implementation, the WIFI interface 907 and the cellular network (GSM or CDMA) adaptor 908 send and receive electrical or electromagnetic signals that carry digital data streams representing various types of information. In one or more embodiments, the network interface 905 may be used to receive the aforesaid color image used in printing.

In one or more embodiments, the Internet 924 typically provides data communication through one or more subnetworks to other network resources. Thus, the onboard computer 900 is capable of accessing a variety of network resources located anywhere on the Internet 924, such as remote media servers, web servers, other content servers as well as other network data storage resources. In one or more embodiments, the onboard computer 900 is configured send and receive messages, media and other data, including application program code, through a variety of network(s) including Internet 924 by means of the network interface 905. In the Internet example, when the onboard computer 900 acts as a network client, it may request code or data for an application program executing in the onboard computer 900. Similarly, it may send various data or computer code to other network resources.

In one or more embodiments, the functionality described herein is implemented by onboard computer 900 in response to processor 901 executing one or more sequences of one or more instructions contained in the memory 912. Such instructions may be read into the memory 912 from another computer-readable medium. Execution of the sequences of instructions contained in the memory 912 causes the processor 901 to perform the various process steps described herein. In alternative embodiments, hard-wired circuitry may be used in place of or in combination with software instructions to implement the embodiments of the invention. Thus, embodiments of the invention are not limited to any specific combination of hardware circuitry and software.

The term "computer-readable medium" as used herein refers to any medium that participates in providing instructions to processor 901 for execution. The computer-readable medium is just one example of a machine-readable medium, which may carry instructions for implementing any of the methods and/or techniques described herein. Such a medium may take many forms, including but not limited to, non-volatile media and volatile media.

Common forms of non-transitory computer-readable media include, for example, a floppy disk, a flexible disk, hard disk, magnetic tape, or any other magnetic medium, a CD-ROM, any other optical medium, punchcards, paper-tape, any other physical medium with patterns of holes, a RAM, a PROM, an EPROM, a FLASH-EPROM, a flash drive, a memory card, any other memory chip or cartridge, or any other medium from which a computer can read. Various forms of computer readable media may be involved in carrying one or more sequences of one or more instructions to processor 901 for execution. For example, the instructions may initially be carried on a magnetic disk from a remote computer. Alternatively, a remote computer can load the instructions into its dynamic memory and send the instructions over the Internet 924. Specifically, the computer instructions may be downloaded into the memory 912 of the onboard computer 900 from the foresaid remote computer via the Internet 924 using a variety of network data communication protocols well known in the art.

In one or more embodiments, the memory 912 of the onboard computer 900 may store any of the following software programs, applications and/or modules:

1. Operating system (OS) 913, which may be a mobile operating system for implementing basic system services and managing various hardware components of the onboard computer 900. Exemplary embodiments of the operating system 913 are well known to persons of skill in the art, and may include any now known or later developed mobile operating systems. Additionally provided may be a network communication module 914 for enabling network communications using the network interface 905.

2. Software modules 915 may include, for example, a set of software modules executed by the processor 901 of the onboard computer 900, which cause the onboard computer 900 to perform certain predetermined functions, such as issue commands to the drivetrain or flight control of the wheeled robot or aerial drone for printing, see, for example, a flight/drive control module 916, a guidance module 917 and a printing module 918.

3. Data storage 919 may be used, for example, for storing the aforesaid color table(s) 920 for determining the color of each pixel to be printed.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, Objective-C, perl, shell, PHP, Java, as well as any now known or later developed programming or scripting language.

Moreover, other implementations of the invention will be apparent to those skilled in the art from consideration of the specification and practice of the invention disclosed herein. Various aspects and/or components of the described embodiments may be used singly or in any combination in the printing systems and methods. It is intended that the specification and examples be considered as exemplary only, with a true scope and spirit of the invention being indicated by the following claims.

What is claimed is:

1. A printing system comprising:

a. a projector configured to project a temporal projector light signal, wherein the temporal projector light signal is encoded, for each pixel of the projector, with an information segment comprising the pixel coordinates of the each pixel of the projector, wherein the pixel coordinates of the each pixel of the projector are encoded into the temporal projector light signal using a plurality of light pulses; and b. an autonomous mobile printing head comprising a drive unit, a light sensor, a color application actuator and an onboard computer operatively coupled to the light sensor, the drive unit and the color application actuator, wherein the light sensor is configured to detect the temporal projector light signal and generate a sensor signal and wherein the onboard computer is configured to receive a sensor signal from the light sensor, to determine a location information of the autonomous mobile printing head based on the detected temporal projector light signal, to issue a guidance command to the drive unit based on the detected location of the autonomous mobile printing head and to issue a color application command to the color application actuator to apply a color to a surface based on the detected location of the autonomous mobile printing head.

2. The printing system of claim 1, wherein the onboard computer of the autonomous mobile printing head determines the location information of the autonomous mobile printing head by identifying a projector pixel corresponding to the sensor signal.

3. The printing system of claim 2, wherein the location information of the autonomous mobile printing head comprises position of the autonomous mobile printing head with respect to a printing surface.

4. The printing system of claim 2, wherein the autonomous mobile printing head comprises a second light sensor configured to detect the temporal projector light signal and generate a second sensor signal and wherein the onboard computer of the autonomous mobile printing head determines the location information of the autonomous mobile printing head by identifying a second projector pixel corresponding to the second sensor signal.

5. The printing system of claim 1, wherein the onboard computer of the autonomous mobile printing head is configured to receive an image that associates a predetermined color pixel to each location of the autonomous mobile printing head on a printing surface and wherein the color application command issued to the color application actuator is based, at least in part, on the detected location of the autonomous mobile printing head and the received image.

6. The printing system of claim 5, wherein the autonomous mobile printing head comprises a wireless receiver configured to receive the image.

7. The printing system of claim 1, wherein the onboard computer of the autonomous mobile printing head is configured to receive a printing path for the autonomous mobile printing head and wherein the guidance command issued to the drive unit is based, at least in part, on the received printing path.

8. The printing system of claim 1, wherein the light sensor is configured to detect a color of the temporal projector light signal and wherein the color application command issued to the color application actuator is based on the detected color.

9. The printing system of claim 1, wherein the temporal projector light signal is encoded, for at least one pixel of the projector, with a color information segment comprising color information corresponding to the at least one pixel of the projector.

10. The printing system of claim 9, wherein the autonomous mobile printing head comprises a suction unit for creating a suction force for forcing the autonomous mobile printing head against a printing surface.

11. The printing system of claim 10, wherein the suction unit is an electrical fan.

12. The printing system of claim 1, wherein the autonomous mobile printing head is an aerial drone, wherein the projector is positioned below the aerial drone, wherein the light sensor is positioned on the bottom side of the aerial drone and wherein the onboard computer issues the guidance command to guide the aerial drone to perform printing.

13. The printing system of claim 1, wherein the autonomous mobile printing head is a wheeled robot.

14. The printing system of claim 1, wherein the autonomous mobile printing head further comprises a color spray can, wherein the color application actuator is an electronically controlled valve.

15. The printing system of claim 1, wherein the autonomous mobile printing head further comprises a pen, wherein the color application actuator is a solenoid configured to move the pen to or from a printing surface.

16. The printing system of claim 1, wherein the autonomous mobile printing head further comprises a water vaporizer, wherein the color application actuator is an electronically controlled valve.

17. The printing system of claim 1, wherein the autonomous mobile printing head comprises a second light sensor configured to detect the temporal projector light signal and generate a second sensor signal, wherein the onboard computer of the autonomous mobile printing head determines orientation information of the autonomous mobile printing head by identifying a projector pixel corresponding to the sensor signal and a second projector pixel corresponding to the second sensor signal and wherein the orientation information is determined based on the identified first projector pixel and the second projector pixel.

18. The printing system of claim 1, wherein the temporal projector light signal projected by the projector comprises a plurality of sequential light pulses encoding pixel coordinates of the each pixel of the projector.

19. The printing system of claim 1, wherein the projector is attached to an aerial drone.

20. A printing method comprising:

a. using a projector to project a temporal projector light signal, wherein the temporal projector light signal is encoded, for each pixel of the projector, with an information segment comprising the pixel coordinates of the each pixel of the projector, wherein the pixel coordinates of the each pixel of the projector are encoded into the temporal projector light signal using a plurality of light pulses;

b. detecting the temporal projector light signal using a light sensor of an autonomous mobile printing head and generating corresponding sensor signal, the autonomous mobile printing head comprising a drive unit and a color application actuator; and c. using an onboard computer of the autonomous mobile printing head to receive the sensor signal, to determine a location of the autonomous mobile printing head based on the detected temporal projector light signal, to issue a guidance command to the drive unit based on the detected location of the autonomous mobile printing head and to issue a color application command to the color application actuator to apply a color to a surface based on the detected location of the autonomous mobile printing head.

21. A tangible computer-readable medium embodying a set of instructions implementing a printing method comprising:

a. using a projector to project a temporal projector light signal, wherein the temporal projector light signal is encoded, for each pixel of the projector, with an information segment comprising the pixel coordinates of the each pixel of the projector, wherein the pixel coordinates of the each pixel of the projector are encoded into the temporal projector light signal using a plurality of light pulses;

b. detecting the temporal projector light signal using a light sensor of an autonomous mobile printing head and generating corresponding sensor signal, the autonomous mobile printing head comprising a drive unit and a color application actuator; and c. using an onboard computer of the autonomous mobile printing head to receive the sensor signal, to determine a location of the autonomous mobile printing head based on the detected temporal projector light signal, to issue a guidance command to the drive unit based on the detected location of the autonomous mobile printing head and to issue a color application command to the color application actuator to apply a color to a surface based on the detected location of the autonomous mobile printing head.

* * * * *